US011864635B2

(12) United States Patent
Benson et al.

(10) Patent No.: US 11,864,635 B2
(45) Date of Patent: Jan. 9, 2024

(54) SECUREMENT DEVICE

(71) Applicant: Orbitkey Pty. Ltd., Kensington (AU)

(72) Inventors: Richard Lucius Benson, Kensington (AU); Kieran Simon Lachlan Ball, Kensington (AU); Marcellino Kennyjie, Kensington (AU); Charles Wijaya Ng, Kensington (AU)

(73) Assignee: ORBITKEY PROJECTS PTY LTD, South Yarra (AU)

( * ) Notice: Subject to any disclaimer, the term of this patent is extended or adjusted under 35 U.S.C. 154(b) by 74 days.

(21) Appl. No.: 17/504,077

(22) Filed: Oct. 18, 2021

(65) Prior Publication Data

US 2023/0121637 A1 Apr. 20, 2023

(51) Int. Cl.
*A44B 15/00* (2006.01)

(52) U.S. Cl.
CPC ..... *A44B 15/005* (2013.01); *A44B 15/002* (2013.01)

(58) Field of Classification Search
CPC ..... A44B 15/005; A44B 15/002; A44B 15/00; Y10T 70/8757; Y10T 70/8676
See application file for complete search history.

(56) References Cited

U.S. PATENT DOCUMENTS 168,832 A 10/1875 Denio et al.
276,826 A 5/1883 Jopson
320,792 A * 6/1885 Jopson ..... A44B 15/00 70/459
368,135 A * 8/1887 Crandall ..... A44B 15/00 70/459
1,341,228 A * 5/1920 Fischer
1,402,072 A * 1/1922 Johnson
3,045,469 A * 7/1926 Rentscher et al.
1,600,118 A * 9/1926 Long
1,626,987 A * 5/1927 Venegas ..... A44B 15/00 70/459

(Continued)

FOREIGN PATENT DOCUMENTS

CN 105795615 A 7/2016
EP 70599 A1 1/1983

(Continued)

OTHER PUBLICATIONS

Australian Patent Office; International Search Report & Written Opinion for International Patent Application No. PCT/IB2022/059947 dated Nov. 24, 2022, 15 Pages.

*Primary Examiner* — Victor D Batson
*Assistant Examiner* — Matthew J Sullivan
(74) *Attorney, Agent, or Firm* — Christopher J. Knors; Moore & Van Allen PLLC

(57) ABSTRACT

A securement device is provided. The securement device comprising: a ring comprising coplanar facing ends separated by a space; and a housing, a lock member positioned at least partially within the housing, wherein the lock member comprises a neck having a width less than the space, and a body having at least a portion with a width greater than the space; wherein the article is configured to adjust from a locked configuration to an unlocked configuration; the locked configuration preventing rotational translation of the ring through the housing; and the unlocked configuration allowing rotational translation of the ring through the housing.

21 Claims, 6 Drawing Sheets

(56) References Cited

U.S. PATENT DOCUMENTS 1,719,662 A * 7/1929 Jones ..... A44C 5/2019 70/459
1,866,216 A 7/1932 Lippstadt
2,294,808 A * 9/1942 Schupbach ..... A44B 15/00 70/459
2,307,808 A * 1/1943 Segal ..... A44B 15/00 70/459
2,503,211 A * 4/1950 Ormsbee ..... A44B 15/00 70/459
2,842,877 A * 7/1958 Stevens
2,855,775 A 10/1958 Marien
2,989,862 A * 6/1961 Segal
3,126,729 A * 3/1964 Leopoldi ..... A44B 15/00 24/615
3,362,201 A * 1/1968 Lachin ..... A44B 15/00 70/459
3,481,169 A * 12/1969 Rossi ..... A45C 11/32 70/456 R
3,513,675 A * 5/1970 Ryder, Jr. ..... A44B 15/00 70/459
3,516,272 A * 6/1970 Modrey ..... A44B 15/00 70/459
3,597,951 A * 8/1971 Nadel ..... A44B 15/00 70/459
3,635,058 A * 1/1972 Polk ..... A44B 15/00 70/459
3,777,523 A * 12/1973 Holland ..... A44B 15/002 70/459
4,051,874 A * 10/1977 Hardy ..... A45F 5/02 140/92.2
4,106,802 A * 8/1978 Lozio ..... G09F 3/14 292/320
4,129,021 A 12/1978 Brentini
4,193,278 A * 3/1980 Martinez ..... A44B 15/00 70/459
4,317,638 A * 3/1982 Klaber ..... A44B 15/005 70/459
4,324,121 A 4/1982 Richter
4,376,383 A * 3/1983 Wolter ..... A44B 15/00 70/459
4,382,319 A * 5/1983 Mendoza
4,656,853 A 4/1987 Mancini
4,741,189 A 5/1988 Battenberg
4,790,161 A * 12/1988 Dick ..... A44B 15/005 70/456 R
4,821,543 A * 4/1989 Scungio
4,891,961 A * 1/1990 Tsamas
D307,213 S 4/1990 Scungio
5,054,638 A * 10/1991 Rose ..... A47G 23/0266 220/759
5,220,319 A * 6/1993 Kendel ..... A44B 15/005 206/37.1
5,299,439 A * 4/1994 Nelson ..... A44B 15/002 70/459
5,438,555 A * 8/1995 Kim ..... B67B 7/16 368/243
5,501,089 A * 3/1996 Song ..... A44B 15/00 70/459
5,528,916 A * 6/1996 Song
5,551,269 A * 9/1996 Lewinstein ..... A44B 15/005 70/459
5,619,875 A * 4/1997 Lahaussois ..... A44B 15/00 70/456 R
5,621,936 A * 4/1997 Penaligon ..... A44B 15/005 81/3.4
D394,545 S * 5/1998 MacDonald ..... D3/207
5,755,648 A * 5/1998 Kildani ..... A63B 23/03508 482/121
5,806,356 A * 9/1998 Lee ..... A44B 15/00 206/38.1
5,813,262 A * 9/1998 Crumley ..... A44B 15/005 70/457
6,262,664 B1 * 7/2001 Maloney ..... G08B 13/2431 340/568.2
6,308,385 B1 * 10/2001 Ball ..... A44C 5/2033 24/599.6
6,334,239 B1 * 1/2002 Kraut ..... A45F 5/02 24/3.1
6,763,692 B1 * 7/2004 Huang ..... A44B 15/00 70/459
6,826,938 B2 * 12/2004 Huang ..... A44B 15/00 70/459
6,848,287 B1 * 2/2005 Huang ..... A44B 15/00 70/459
D542,024 S 5/2007 Bulgari
D551,441 S 9/2007 Bulgari
7,690,091 B2 * 4/2010 Stobbe ..... A44B 15/00 70/459
7,966,853 B2 6/2011 Maier-Hunke
8,028,556 B2 * 10/2011 Brown ..... G09F 3/0305 292/307 R
8,572,813 B2 * 11/2013 Monaco
9,055,789 B2 * 6/2015 Danforth, Jr. ..... A44B 15/00
9,474,335 B2 * 10/2016 Heller
9,810,256 B2 * 11/2017 Blizzard ..... A44B 15/00
10,178,896 B1 * 1/2019 Huang ..... A45F 5/022
10,624,426 B2 * 4/2020 Adelman ..... A44B 15/002
11,564,460 B2 * 1/2023 Garda ..... A44B 15/00
11,596,209 B2 * 3/2023 Inkavesvaanit ..... A44B 15/007
2004/0201983 A1 * 10/2004 Yu ..... F21L 4/027 362/157
2005/0103071 A1 * 5/2005 Ng ..... A44B 15/00 70/459
2008/0072639 A1 * 3/2008 Kurdziel ..... A45F 5/00 224/272
2008/0129448 A1 6/2008 Reichling
2012/0023716 A1 * 2/2012 Bluma ..... F16B 45/00 24/566
2015/0289603 A1 * 10/2015 Jiang ..... A44B 15/005 70/456 R

FOREIGN PATENT DOCUMENTS

JP 57104982 U 6/1982
JP 3087689 U 8/2002
KR 101290315 B1 7/2013
WO 02089628 A1 11/2002
WO 2008081062 A2 7/2008
WO 2020169856 A1 8/2020

* cited by examiner

SECUREMENT DEVICE

FIELD OF THE DISCLOSURE

The present disclosure relates to a securement device configured to adjust from a locked configuration to an unlocked configuration, as well as a method of manufacture of the same.

SUMMARY

The following presents a simplified summary of one or more embodiments of the disclosure in order to provide a basic understanding of such embodiments. This summary is not an extensive overview of all contemplated embodiments and is intended to neither identify key or critical elements of all embodiments, nor delineate the scope of any or all embodiments. Its sole purpose is to present some concepts of one or more embodiments in a simplified form as a prelude to the more detailed description that is presented later.

In a first example, article is provided. The article comprising: a ring comprising coplanar facing ends separated by a space; and a housing comprising a width; a length; at least one pathway through the width of the housing; and a lock member positioned at least partially within the housing, wherein the lock member comprises a neck having a sectional width less than the space and a body adjacent the neck, the body having at least a portion thereof wider than the space; wherein the article is configured to reversibly transition from a first configuration to a second configuration by the application of an external force; the first configuration being defined by the neck at least partially engaging the space such that the ring is prevented from translating through the housing; and the second configuration being defined by the ring being translatable through the at least one pathway of the housing.

In one aspect, adjusting from the first configuration to the second configuration requires expanding the coplanar facing ends planarly to a width greater than the width of the body of the lock member.

In another aspect, alone or in combination with any of the previous aspects, the ring is annular or non-annular in shape between the coplanar facing ends.

In another aspect, alone or in combination with any of the previous aspects, the ring is annular in shape and continuous between the coplanar facing ends.

In another aspect, alone or in combination with any of the previous aspects, each of the coplanar facing ends of the ring comprise a coplanar linear section.

In another aspect, alone or in combination with any of the previous aspects, the external applied force for transitioning from the first configuration to the second configuration is essentially the same, less than, or greater than the external applied force for transitioning from the second configuration to the first configuration.

In another aspect, alone or in combination with any of the previous aspects, a cross-section shape of the ring is sized to fit within an opening in at least one of: a key, an NFC fob, an RF fob, a keychain, a keychain card, ID card holder, or a carabiner.

In the second example, an article is provided, the article comprising a ring comprising coplanar facing ends separated by a space; and a housing comprising opposed opened sides separated by a width; a first closed end and an at least partially closed second end separated from the first closed end by a length; a lock member positioned at least partially within the housing, wherein the lock member comprises a neck adjacent to the first closed end, the neck having a sectional width less than the space; and a body adjacent to and projecting from the neck, the body having at least a portion wider than the space, the body terminating at a distal end spatially separated from the second closed end; and a pathway between the opposed open sides and between the distal end and the second end; wherein the article is configured to reversibly transition from a locked configuration to an unlocked configuration; the locked configuration being defined by the neck at least partially engaging the space such that the ring is prevented from translating through the housing; and the unlocked configuration being defined by the ring being translatable through the pathway.

In one aspect, adjusting from the locked configuration to the unlocked configuration requires expanding the coplanar facing ends planarly to a width greater than the body of the lock member.

In another aspect, alone or in combination with any of the previous aspects, each of the coplanar facing ends of the ring comprise a coplanar linear section.

In another aspect, alone or in combination with any of the previous aspects, the ring is annular or non-annular in shape between the coplanar facing ends.

In another aspect, alone or in combination with any of the previous aspects, an external applied force allows transitioning from the first configuration to the second configuration, and wherein the external applied force is essentially the same, less than, or greater than the external applied force for transitioning from the second configuration to the first configuration.

In another aspect, alone or in combination with any of the previous aspects, a cross-section of the ring is sized to fit within an opening in at least one of: a key, an NFC fob, an RF fob, a keychain, a keychain card, ID card holder, or a carabiner.

In a third example, a method of manufacturing a securement device is also provided. The method comprising: forming a ring comprising coplanar facing ends separated by a space having a width; forming a housing comprising a pathway therethrough; providing a lock member positioned at least partially within the housing, the lock member having a neck with at least a portion obstructing the pathway and a body, wherein the neck has a width less than the width of the space and a body has at least a portion thereof with a width greater than the space; and enclosing a portion of the ring within the housing.

In one aspect, the ring is annular or non-annular in shape between the coplanar facing ends.

In another aspect, alone or in combination with any of the previous aspects, forming the housing comprises stamping and/or bending of metal, metal molding, die-casting, or metal injection molding (MIM).

In another aspect, alone or in combination with any of the previous aspects, forming the housing comprises, injection molding or printing the housing via a 3D printer and wherein forming the ring comprises printing the member via a 3D printer.

In another aspect, alone or in combination with any of the previous aspects, the 3D printer is a selective laser sintering (SLS) printer.

In another aspect, alone or in combination with any of the previous aspects, the 3D printer is a computer numerical control (CNC) mill.

In another aspect, alone or in combination with any of the previous aspects, the ring and/or the housing comprises metal.

BRIEF DESCRIPTION OF THE DRAWING

Figure 1A:
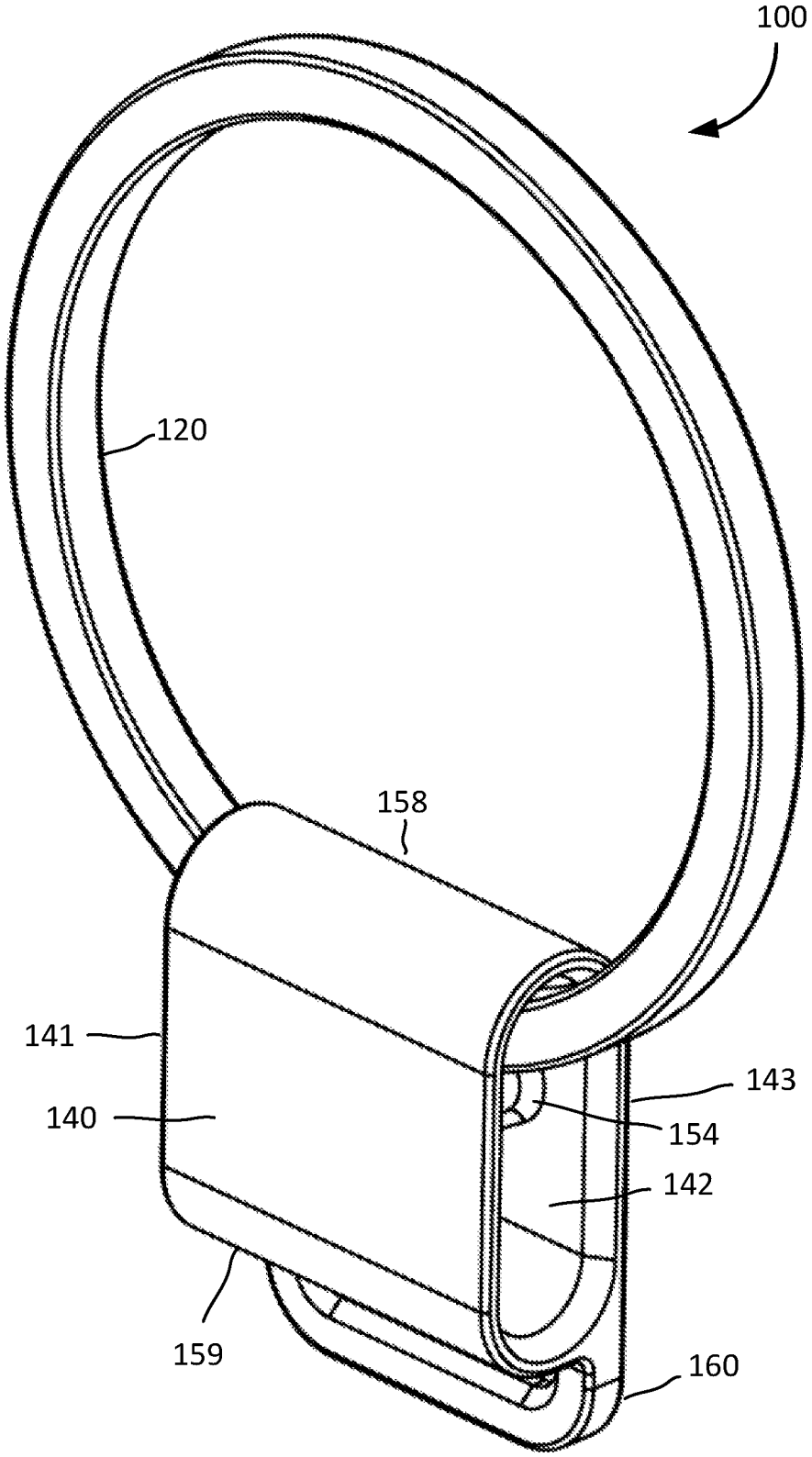

Having thus described embodiments of the disclosure in general terms, reference will now be made to the accompanying drawing, wherein:

FIG. 1A illustrates a perspective view of an exemplary securement device in a locked configuration, in accordance with one embodiment of the present disclosure.

Figure 1B:
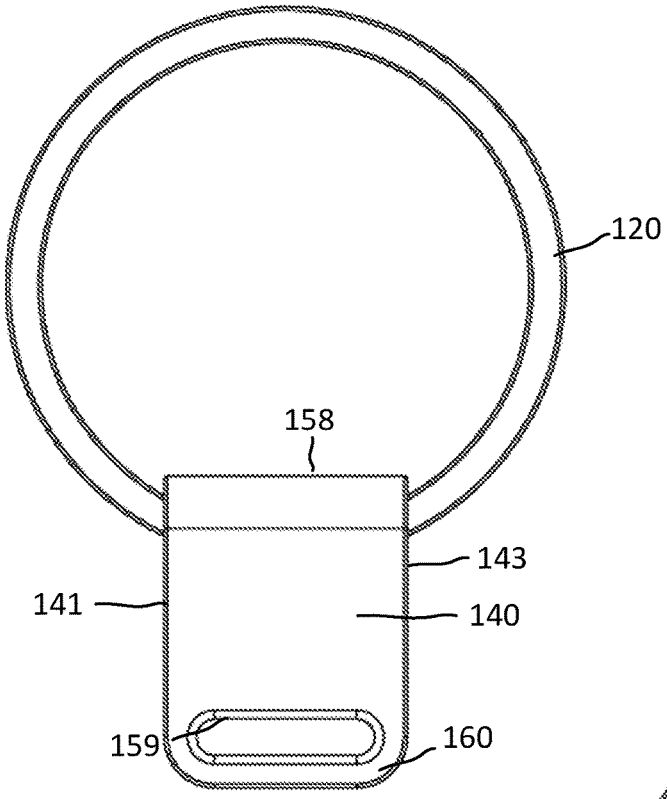

FIG. 1B illustrates a front view of the securement device of FIG. 1A in the locked configuration, in accordance with one embodiment of the present disclosure.

Figure 1C:
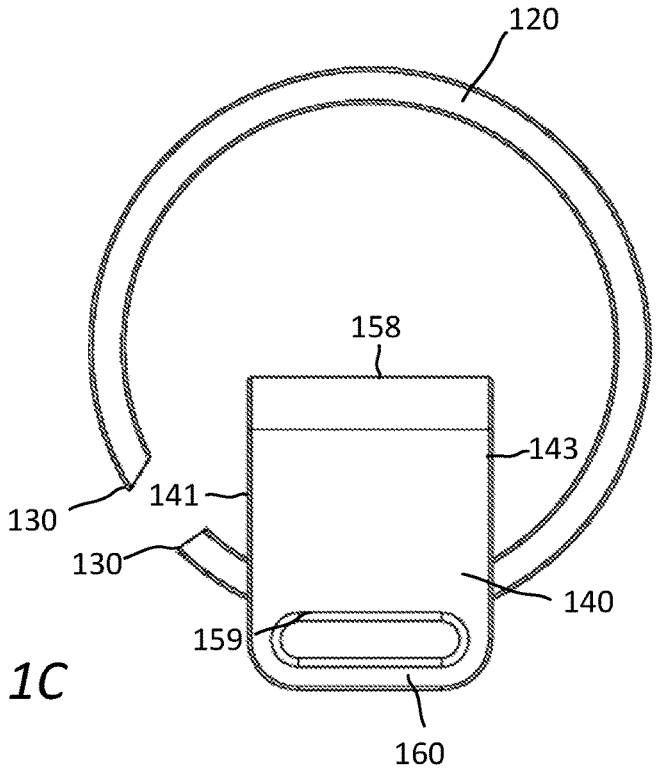

FIG. 1C illustrates a front view of the securement device of FIG. 1A in an unlocked configuration, in accordance with one embodiment of the present disclosure.

Figure 2A:
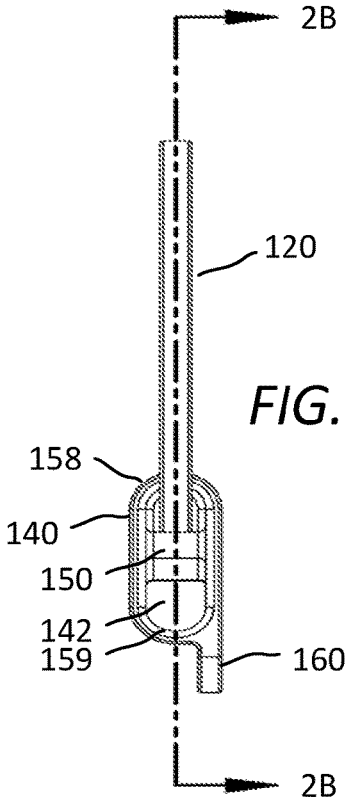
Figure 2B:
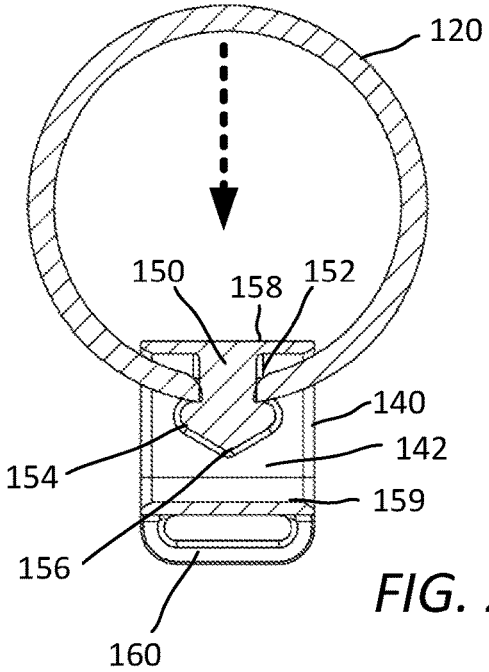

FIG. 2A illustrates a side view of the exemplary securement device in a locked configuration, in accordance with one embodiment of the present disclosure FIG. 2B illustrates a section view along section line 2B-2B of FIG. 2A, showing the securement device in the locked configuration, in accordance with one embodiment of the present disclosure.

Figure 3A:
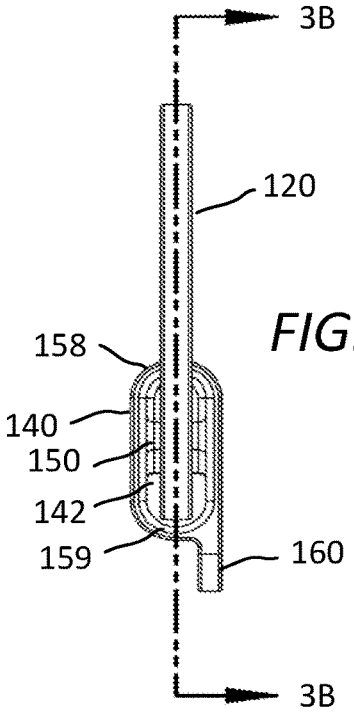

FIG. 3A illustrates a side view of the exemplary securement device in an unlocked configuration, in accordance with one embodiment of the present disclosure.

Figure 3B:
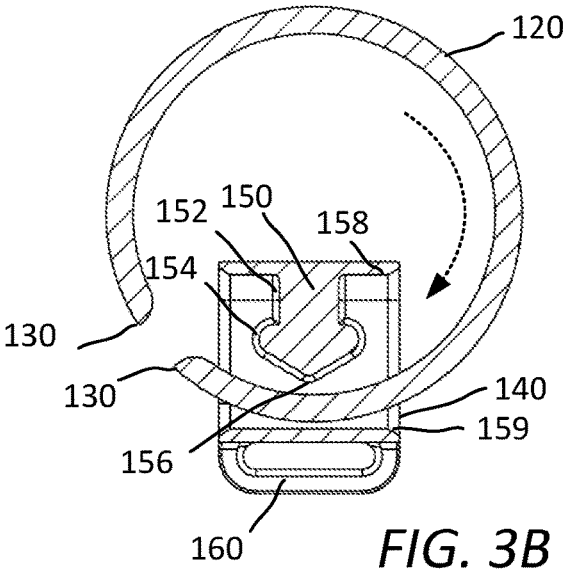

FIG. 3B illustrates a section view along section line 3B-3B of FIG. 3A, showing the securement device in the unlocked configuration, in accordance with one embodiment of the present disclosure.

Figure 4A:
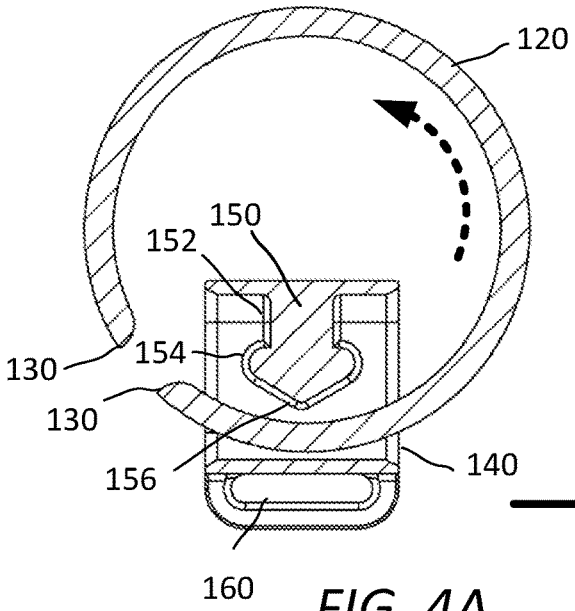

FIG. 4A illustrates the exemplary securement device in an unlocked configuration, with the ring being positioned for locking in accordance with the present disclosure.

Figure 4B:
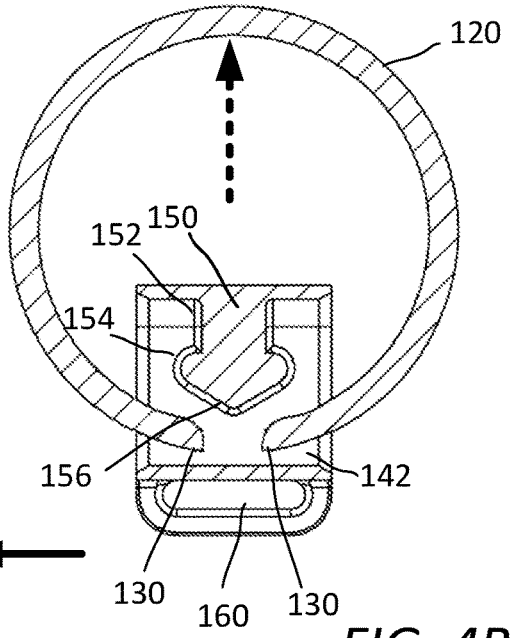

FIG. 4B illustrates the ring of the exemplary securement device positioned for transition to the locked configuration, in accordance with the present disclosure.

Figure 4C:
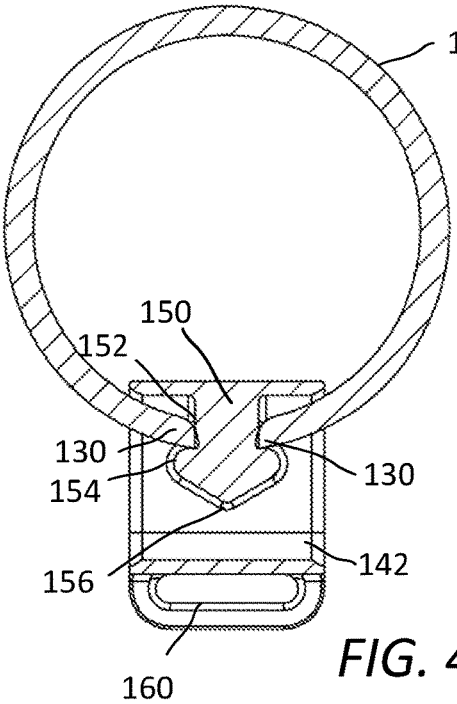

FIG. 4C illustrates a back view of the exemplary securement device in a locked configuration, in accordance with one embodiment of the present disclosure.

Figure 5A:
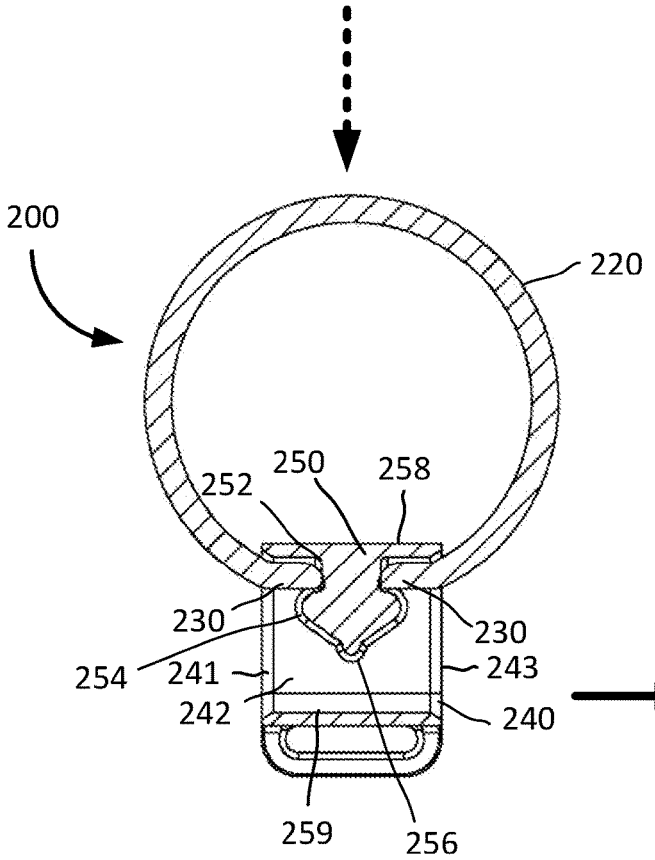

FIG. 5A illustrates an alternate securement device, in a locked configuration in accordance with one embodiment of the present disclosure.

Figure 5B:
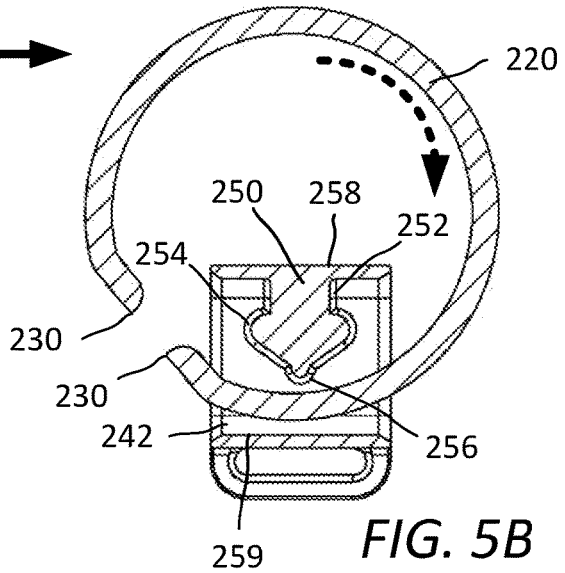

FIG. 5B illustrates the alternate securement device in an unlocked configuration providing rotation of the ring through the housing in accordance of the present disclosure.

Figure 6:
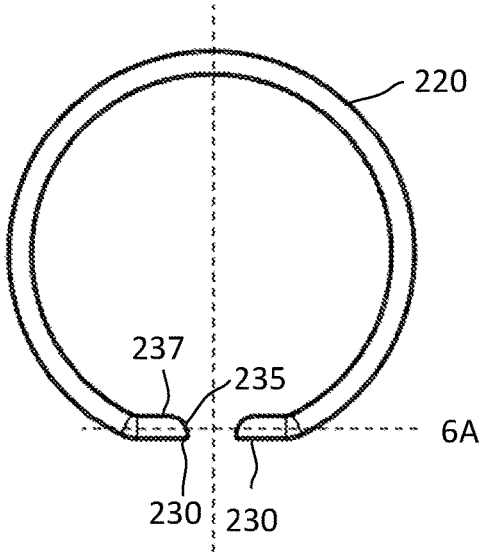

FIG. 6 illustrates an alternate ring for the securement device in accordance with the present disclosure.

Figure 7A:
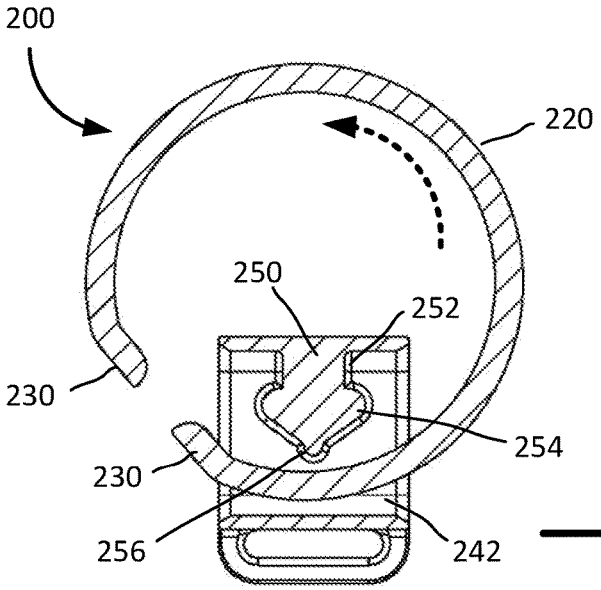

FIG. 7A illustrates the alternative securement device in an unlocked configuration, with the ring being positioned for locking in accordance with the present disclosure.

Figure 7B:
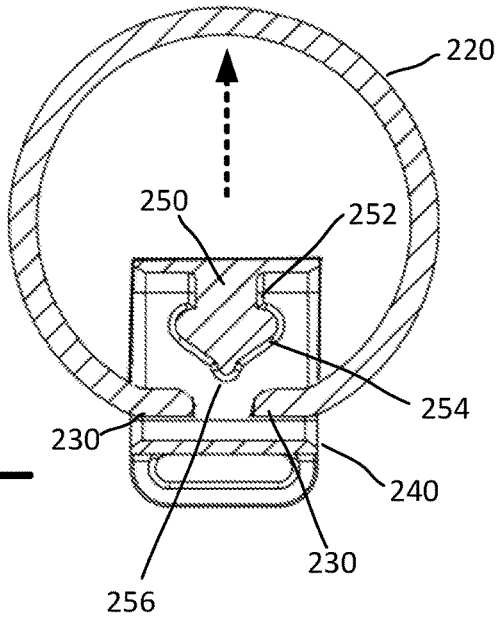

FIG. 7B illustrates the ring of the alternative securement device positioned for transition to the locked configuration, in accordance with the present disclosure.

Figure 7C:
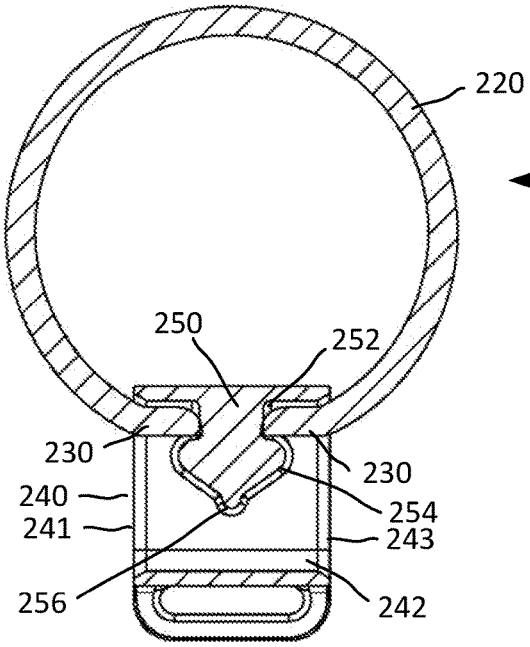

FIG. 7C illustrates the alternative securement device in the locked configuration in accordance with the present disclosure.

DETAILED DESCRIPTION

Embodiments of the present disclosure now may be described more fully hereinafter with reference to the accompanying drawings, in which some, but not all, embodiments of the disclosure are shown. Indeed, the disclosure may be embodied in many different forms and should not be construed as limited to the embodiments set forth herein; rather, these embodiments are provided so that this disclosure may satisfy applicable legal requirements. Like numbers refer to like elements throughout.

Also, it will be understood that, where possible, any of the advantages, features, functions, devices, and/or operational aspects of any of the embodiments of the present disclosure described and/or contemplated herein are combinable and/or included in any of the other embodiments of the present disclosure described and/or contemplated herein, and/or vice versa. In addition, where possible, any terms expressed in the singular form herein are meant to also include the plural form and/or vice versa, unless explicitly stated otherwise.

Embodiments of the present disclosure are directed to a securement device and a method of manufacture of said securement device. In one example, the securement device comprises a ring which is configured to reversibly receive one or more keys, fobs, keychains, or the like. Conventional devices which are configured to perform similar functions, such as keyrings with locking devices having springs, are often rigid and difficult to manufacture do to internal components, difficult to open or close, making the addition or removal of keys challenging. As such, there exists for an improved device which is able to securely hold multiple keys or fobs while allowing a user to easily add or remove them. Embodiments of the present disclosure are directed to, for example, a two piece construction of a securement device which adjusts from a locked configuration to an unlocked configuration with application of an external force. In one example, the presently disclosed device is devoid of springs or separate internal components. In one example, the external force required to transition the securement device from the locked configuration to the unlocked position is less than the force required to transition the securement device from the unlocked configuration to the locked position.

Thus, the present disclosure provides the benefit of a traditional, secure keyring while in the locked configuration as well as an additional ease-of-use benefit while in the unlocked configuration. The presently disclosed securement device is more inclusive of a wider user group as it requires less dexterity than standard split ring devices, can be fabricated from a variety of premium materials (e.g., gold, platinum), and provided with strong and reliable construction. In one example, the presently disclosed securement device provides tactile and audible lock and unlock feedback to the user providing confidence in operation.

In one example, the opening is presented to the user directly after its unlocked. This opening is not otherwise affected by the amount or type of objects already present about the ring. Unlike conventional split rings, where keys or other items can hinder the removal/addition of objects, the present disclosure provides an improvement in that addition/removal of objects about the ring is facilitated with reduced or eliminated hinderance.

FIG. 1A depicts a perspective view of the securement device 100, in accordance with embodiments of the present disclosure. As shown in FIG. 1A, 1B the securement device is an a locked, or first, position. As shown in FIG. 1C, the securement device is in an unlocked, or second configuration providing for the securement of keys, key fobs, ID card holder, and essentially any small object having an opening that can be threaded with the opposed ends 130.

In one example, the securement device 100 comprises a ring 120 and a housing 140. In one example, housing 140 is generally rectangular shaped, circular shaped, or is of any other shape or combination of shapes. As shown in FIG. 1A, housing 140 is generally rectangular. In other examples, housing 140 can be of any other shape. In one example, the housing comprises an opening 160 for attaching the securement device 100 to another article. In one example, the housing 140 is absent of opening 160. In one example, housing 140 is fixed to another article, for example, via a screw, rivet or other mechanical fixing, or the housing 140 is laminated on one or all exterior faces of the housing, e.g., including using glue or injection molding another material or article around the housing such that the housing becomes embedded therein. In one example, arranged raised ribs or dots are added to the external faces of housing 140 for securing within the molded plastic/rubber etc, or such ribs/dots are provided on the external faces of the housing for ergonomically control by the user during use.

In one example, housing 140 is configured with a width of about 5 mm-20 mm (mm=millimeters), a length of about 8 mm-30 mm and a thickness of about 3 mm-10 mm. Other housing dimensions can be used.

In one example, the ring 120 may have an annular shape, such as a circle, oval, ellipse, or be combinations of shapes. In one example, the ring 120 may have a non-annular shape, such as a rectangle, figure-8, triangle, square, or combinations of shapes. In one example, the ring 120 is discontinuous, having coplanar, spaced apart opposing ends 130 that face each other. In one example, the space between each of the opposed ends 130 is sufficiently spaced to receive an opening of a key, key fob, etc. In one example, the space between each of the opposed ends 130 is between about 2 mm to about 6 mm. In one example, the space between each of the opposed ends is between about 3 mm to about 5 mm.

In one example, the cross-section shape of the ring 120 may be annular or non-annular, and is sized to receive an opening of keys, keycards, fobs, and/or the like for securement. In one example, the thickness (or diameter) of the cross-section shape of the ring 120 is between about 1.5 mm to about 3.5 mm. In one example, the thickness or diameter of the cross-section shape of the ring 120 is between about 1 mm to about 2 mm, 3 mm, 4 mm or 5 mm.

In one example, the coplanar ends 130 of the ring 120 are beveled in order to facilitate the adjustment from the first configuration shown in FIG. 2A to the second configuration shown in FIG. 2B. In one example, the bevel tapers from the inside perimeter of coplanar ends 130 of the ring 120 towards the outside perimeter of the ring. In one example, the absence of a bevel on the outside edge reduces the likelihood of accidental unlocking, for example, by increasing the force required for the coplanar ends to separate and pass over the lock member 150.

In one example, housing 140 is at least partially opened on two opposite sides 141, 143 that are separated by a width so as to create at least one pathway through the width of the housing 140, and the housing is essentially closed on two opposite sides 158, 159 (or "first and second ends") that are separated by a length. As depicted in FIGS. 2A-3B, in one example, the housing 140 comprises at least one pathway 142 through the opened opposing sides 141, 143. In one example, the housing 140 is at least partially obstructed by a lock member 150 projecting lengthwise from one closed end of housing 140. In one example, the lock member comprises a neck 152 of a width sized to receive the separated opposed ends 130 of ring 120. In one example, the width of the neck 152 is equal to or slightly less than or greater than (e.g., 1-5%) the space between the opposing ends 130.

In one example, the neck 152 of the lock member is integral with a body 154 having a width greater than the separation of the opposed ends 130 of ring 120. In one example, the body 154 tapers lengthwise on one or both sides towards the opposite closed end 159 and terminates at distal end 156. Distal end 156 is spatially separated from the opposed closed end 159 of the housing 140 defining a pathway 142 through the open sides 141, 143 of the housing.

In one example, the neck 152 and body 154 of lock member 150 are configured in a spade shape, diamond shape, or other shape. In one example, the lock member 150 is provided as a spade shape so as to facilitate reduced force locking, while also preventing accidental unlocking. As shown in FIG. 1A, in one example, the width of the neck 152 is narrower than or equal to the space between the opposing ends 130 of the ring 120. In one example, the body 154 is wider than the space between the opposing ends 130. In one example, the width of the body is between about 5 mm to about 10 mm. In one example, the width of the body is between about 6 mm to about 8 mm.

In an example, the edges or surface of the body 154 are rounded in order to facilitate the transition from the first configuration (locked configuration) shown in FIG. 1A, to the second configuration (unlocked configuration) shown in FIG. 1B.

FIGS. 1A, 2A, 2B depicts the securement device 100 in a locked, or first configuration. In an example, the first configuration is defined by the opposing ends 130 of the ring 120 being received in and secured around the neck 152 of the lock member 150. As depicted, the neck 152 prevents rotational translation of the ring 120 through the pathway 142 of housing 140. In one example, the ring 120 and the housing 140 lie in the same plane (are co-planar with each other). In one example, the thickness of housing 140 and the cross-section/diameter of the ring 120 are sized or shaped so as to prevent pivoting about the neck 152 of the plane of the ring 120 out of the plane of housing 140. For example, the cross section of the ring 120 can be square and be received by the housing 140 with little clearance between the thickness of the housing so as to prevent pivoting about the neck 152.

In another example, in the first configuration, the cross-section of ring 120 is sized or shaped to pivot the plane of the ring out of plane of the housing 140. For example, the cross section of the ring 120 can be round or oval and be received by the housing 140 with clearance between the thickness of the housing.

FIGS. 1B, 3A, 3B depicts the securement device 100 in an unlocked, or second configuration. In an example, the second configuration is defined by the opposing ends 130 of the ring 120 being located beneath the body 154 of the lock member 150 such that the ring 120 is free to rotationally translate through the pathway 142. In the second configuration, the opposing ends 130 can be rotated outside of the housing 140 presenting the space between the opposing ends 130 to receive an article such as a key, keyring, key fob, ID holder, or the like.

As shown in FIGS. 3A, 3B, the securement device 100 is transitioned from the first configuration to the second configuration upon receiving an external force (e.g., a push or a pull sufficient to expand the opposing ends 130 greater than the width of the tapered body 154 of the lock member and into the pathway 142. Once the opposing ends 130 are presented to the pathway 142, ring 120 can rotationally translate (rotated by user) through the pathway 142 so as to present the space between the opposing ends 130 for receiving an article such as a key, keyring, key fob, ID holder, or the like.

In one example, the opposing ends 130 have beveled edges and the body 154 has rounded edges in order to facilitate expansion of the opposing ends 130 beyond the width of the body 154, for example, reducing the force required to expand the opposed ends 130 of the ring 120 beyond the width of the body 154. In one example, pivoting of the ring 120 allows the beveled opposed ends 130 of the ring (as shown in FIGS. 2A, 2B) to be selectively presented for engagement with the body 154 of lock member 150. In one example, the unlocking force is increased when the ring 120 is positioned coplanar relative to the plane of the housing 140. In one example, the unlocking force is decreased when the ring 120 is rotated from the coplanar orientation (for example, between 140 to 220 degrees from coplanar) relative to the plane of the housing 140 because the widest space between the coplanar opposing ends 130 of the ring 120 is presented to the body 154 of lock member 150.

FIGS. 4A-4C depicts the transition from the unlocked configuration to the locked configuration of securement device 100, where ring 120 is rotationally translated through the pathway 142 presenting the space between the opposing ends 130 to the distal end 156 of lock member 150. An external force applied to the ring 120 or housing 140 so as to expand opposing ends 130 beyond the width of the body 154, and the opposing ends are then received and secured by neck 152 in the locked configuration. In one example, tactile and audio feedback are provided to the user during the transition from the unlocked configuration and the locked configuration.

FIGS. 5A and 5B depicts section views of an alternate securement device 200, having a similar housing construction to that of securement device 100 but for lock member 250 and ring 220. In one example, housing 240 is at least partially opened on two opposite sides 241, 243 that are separated by a width so as to create at least one pathway through the width of the housing 240. In one example, housing 140 is essentially closed on two opposite sides 158, 159, or 258, 259 (or "first and second ends" respectfully) that are separated by a length. In one example, housing 140 is at least partially open on side 158, 259.

The alternate securement device 200 comprises a ring 220 and a housing 240. In one example, the ring 220 has a substantially annular shape, such as a circle, oval, ellipse, or the like. In another example, the ring 220 may have a non-annular shape, such as a rectangle, figure-8, triangle, square, or the like. The ring 220 is discontinuous in shape, having coplanar, opposing ends 230 that face each other and define a space between them. In one example, the space between each of the opposed ends 230 is between about 2 mm to about 6 mm. In one example, the space between each of the opposed ends 230 is between about 3 mm to about 5 mm.

As shown in FIG. 5A, the securement device 200 is in a locked, or first configuration. As shown in FIG. 5B, the securement device is in an unlocked, or second configuration providing for the securement of keys, keyfobs and the like. Use of securement device 200 is essentially identical to that of the use of securement device 100.

FIG. 6 illustrates ring 220 of the alternate securement device 200 in accordance with the present disclosure. As shown in FIG. 6, opposed ends 230 of ring 220 are coplanar and have linear portion 237 adjacent the opposed ends along line 6A. In one example, opposed ends 230 are coplanar and have a linear portion 237 directly adjacent the opposed ends. In one example, the length of the linear portion 237 of each of opposed ends is substantially the same. In one example, linear portion 237 increases the contact area about the transition section of the neck 252 and the body 254 of lock member 250. In one example, the linear portion 237 allows the ring to rotate within the housing 240 and about lock member 250 through a simplified axes, providing for a reduction of the overall size of the securement device 200 and/or lock member 250. In one example, linear portion 237 of the ring 220 increases the forces required to lock and unlock the assembly, by increasing the force required to pull ring 220 around lock member 250.

In one example, the length of the linear portion 237 of each of opposed ends is between about 2.5 mm to about 4.5 mm. In one example, the length of the linear portion 237 of each of opposed ends is between about 3.6 mm to about 4.0 mm. In one example, the thickness or diameter of the ring 220 is between about 1.5 mm to about 3.5 mm. In one example, the cross-sectional thickness or diameter of the ring 220 is between about 1.8 mm to about 2.2 mm.

In one example, the opposed ends 230 are beveled 235 in order to facilitate the adjustment from the first configuration shown in FIG. 5A to the second configuration shown in FIG. 5B. In one example, the bevel tapers from the inside perimeter of coplanar ends 230 of the ring 220 towards the outside perimeter of the ring. The cross-section of the ring 220 may be annular or non-annular, and is sized to receive an opening of keys, keycards, fobs, and/or the like for securement.

FIG. 7A-7C illustrates the alternative securement device 200 in an unlocked configuration, transitioning to the locked position, where ring 220 is rotationally translated through the pathway 242 presenting the space between the second closed end 230 to the distal end 256 of lock member 250. An external force applied to the ring 220 or housing 240 so as to expand opposing ends 230 beyond the width of the body 254, and the opposing ends are then received and secured by neck 252 in the locked configuration.

In one example, tactile and audio feedback are provided to the user during the transition from the unlocked configuration and the locked configuration. Body 254 includes additional structure at distal end 256, such as a tip or bulge. In one example, the tip or bulge at distal end 256 provides for tactile feedback when opposing ends 230 are substantially in alignment or position for transitioning from the unlocked configuration to the locked configuration.

The securement device 100, 200 may be manufactured by forming the ring 120, 220 forming the housing 140, 240 and lock member 150, 250 and then enclosing a portion of the ring 120, 220 within the housing 140, 240. In one example, housing 140, 240 and lock member 150, 250 are formed from a single piece of sheet material (e.g., stamping and bending) or are formed separately from the same or different materials and then subsequently coupled together. In one example, ring 120, 220 is formed with the opposing ends 130, 230 separated by a space, or the ring 120, 220 may be formed as a continuous shape (e.g., cut from a tubular form) before a section is removed to create the space between opposing ends 130, 230. Multiple manufacturing techniques may be used to form the components of the securement device, including but not limited to 3D printing, selective laser sintering (SLS), sand casting, die casting or other forms of casting, metal stamping, extruding, material forming, or computer numerical control (CNC) milling. The ring 120, 220 and/or housing can be of metal, composite, ceramic or plastic. In one example, the ring 120, 220 is high stiffness steel with excellent spring back properties, for example SS304H or SS304H hardened. In one example, the housing 140, 240 is SS316 steel.

It should be understood that while only one device configuration is depicted with respect to the figures, these embodiments are non-limiting. It is envisioned that additional or alternative configurations may be included in the design of the securement device, as well as the method of manufacture of the same. While certain exemplary embodiments have been described and shown in the accompanying drawings, it is to be understood that such embodiments are merely illustrative of and not restrictive on the broad disclosure, and that this disclosure not be limited to the specific constructions and arrangements shown and described, since various other changes, combinations, omissions, modifications and substitutions, in addition to those set forth in the above paragraphs, are possible. Those skilled in the art will appreciate that various adaptations, modifications, and combinations of the just described embodiments can be configured without departing from the scope and spirit of the invention. Therefore, it is to be understood that, within the scope of the appended claims, the invention may be practiced other than as specifically described herein.

What is claimed is:

1. An article comprising:

a ring comprising coplanar facing ends separated by a space;

a housing having a pathway therethrough; and a lock member positioned at least partially within the housing, wherein the lock member comprises a neck having a width narrower than the space and a body adjacent the neck, the body having at least a portion thereof that is wider than the space;

wherein the article is configured to reversibly transition between a first configuration and a second configuration by passing the body of the lock member through the space upon application of an external force;

the first configuration being defined by the neck at least partially engaging the space with the body being located outside a perimeter of the ring such that the ring is prevented from translating through the housing; and the second configuration being defined by the body being located within the perimeter of the ring such that the ring is translatable through the pathway of the housing.

2. The article of claim 1, wherein adjusting from the first configuration to the second configuration requires expanding the coplanar facing ends planarly greater than the body of the lock member.

3. The article of claim 1, wherein the ring is annular or non-annular in shape between the coplanar facing ends.

4. The article of claim 1, wherein each of the coplanar facing ends of the ring comprise a coplanar linear section.

5. The article of claim 1, wherein the external applied force for transitioning from the first configuration to the second configuration is essentially the same, less than, or greater than the external applied force for transitioning from the second configuration to the first configuration.

6. The article of claim 1, wherein a cross-section shape of the ring is sized to fit within an opening in at least one of: a key, an NFC fob, an RF fob, a keychain, a keychain card, or a carabiner.

7. A securement device comprising:

a ring comprising coplanar facing ends separated by a space; and a housing comprising:

opposed opened sides separated by a width;

a first closed end and an at least partially closed second end separated from the first closed end by a length; and a pathway between the opened sides of the housing that is disposed towards the second end thereof;

a lock member positioned at least partially within the housing, wherein the lock member comprises a neck adjacent the first closed end and a body adjacent to the neck, with the neck having a width narrower than the space and the body having at least a portion that is wider than the space, the body terminating at a distal end spatially separated from the second end;

wherein the securement device is configured to reversibly transition between a locked configuration and an unlocked configuration by passing the body of the lock member through the space;

the locked configuration being defined by the neck at least partially engaging the space with the body being located outside a perimeter of the ring such that the ring is prevented from translating through the housing; and the unlocked configuration being defined by the body being located within the perimeter of the ring such that the ring is translatable through the pathway.

8. The securement device of claim 7, wherein adjusting from the locked configuration to the unlocked configuration requires expanding the coplanar facing ends greater than the body of the lock member.

9. The securement device of claim 7, wherein an external applied force allows transitioning from the locked configuration to the unlocked configuration, and wherein the external applied force is essentially the same, less than, or greater than the external applied force for transitioning from the unlocked configuration to the locked configuration.

10. The securement device of claim 7, wherein the ring is annular or non-annular in shape between the coplanar facing ends.

11. The securement device of claim 7, wherein each of the coplanar facing ends of the ring comprise a coplanar linear section.

12. The securement device of claim 7, wherein a cross-section of the ring is sized to fit within an opening in at least one of: a key, an NFC fob, an RF fob, a keychain, a keychain card, ID card holder, or a carabiner.

13. A method of manufacturing a securement device, the method comprising:

forming a ring comprising coplanar facing ends separated by a space;

forming a housing comprising a pathway therethrough;

providing a lock member positioned at least partially within the housing, the lock member having a neck that is selectably engageable with the space and a body having at least a portion thereof that is wider than the space; and enclosing a portion of the ring within the housing;

wherein the securement device is configured to transition between a locked configuration, in which the ring is prevented from translating through the housing with the neck being engaged with the space and with the body being located outside a perimeter of the ring, and an unlocked configuration, in which the ring is translatable through the pathway with the body being located within the perimeter of the ring, by passing the body of the lock member through the space.

14. The method of claim 13, wherein the ring is annular or non-annular in shape between the coplanar facing ends.

15. The method of claim 13, wherein a cross-section of the ring is sized to fit within an opening in at least one of: a key, an NFC fob, an RF fob, a keychain, a keychain card, ID card holder, or a carabiner.

16. The method of claim 13, wherein forming the housing comprises metal injection molding (MIM), die-casting metal, stamping and/or bending of metal.

17. The method of claim 13, wherein forming the housing comprises printing the housing via a 3D printer and/or wherein forming the ring comprises printing the ring via a 3D printer.

18. The method of claim 13, wherein the 3D printer is a selective laser sintering (SLS) printer.

19. The method of claim 13, wherein the 3D printer is a computer numerical control (CNC) mill.

20. The method of claim 13, wherein the ring and/or the housing comprises metal.

21. An article comprising:

a ring comprising coplanar facing ends separated by a space;

a housing having a pathway therethrough; and a lock member positioned at least partially within the housing, wherein the lock member comprises a neck having a width narrower than the space and a body adjacent the neck, the body having at least a portion thereof that is wider than the space;

the article being configured to reversibly transition between a first configuration and a second configuration upon application of an external force;

the first configuration being defined by the neck at least partially engaging the coplanar facing ends such that the ring is prevented from translating through the housing by the lock member; and the second configuration being defined by the ring being spaced from the lock member such that the ring is translatable through the pathway of the housing;

wherein adjusting the article between the first and second configurations comprises expanding the coplanar facing ends of the ring planarly greater than the body of the lock member.

* * * * *